US008758057B2

(12) United States Patent
Lan et al.

(10) Patent No.: US 8,758,057 B2
(45) **Date of Patent: *Jun. 24, 2014**

(54) CABLE-TO-BOARD CONNECTOR

(75) Inventors: Rong-Qin Lan, New Taipei (TW); Li-Jun Xu, New Taipei (TW); Ming-Han Lin, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 342 days.

This patent is subject to a terminal disclaimer.

(21) Appl. No.: 13/354,542

(22) Filed: Jan. 20, 2012

(65) Prior Publication Data

US 2013/0189878 A1 Jul. 25, 2013

(51) Int. Cl.
*H01R 13/648* (2006.01)

(52) U.S. Cl.
USPC ..... 439/607.19

(58) Field of Classification Search
USPC ..... 439/607.27, 607.17, 607.18, 607.44, 439/607.54–607.56, 660, 676, 682, 692, 439/607.25, 607.35, 607.36, 607.39, 357
See application file for complete search history.

(56) References Cited

U.S. PATENT DOCUMENTS

| | | | | |
|---|---|---|---|---|
| 7,318,752 | B2 * | 1/2008 | Fujimoto et al. | 439/660 |
| 8,123,544 | B2 * | 2/2012 | Kobayashi | 439/352 |
| 8,348,701 | B1 * | 1/2013 | Lan et al. | 439/607.19 |
| 8,568,173 | B2 * | 10/2013 | Wu | 439/660 |

* cited by examiner

*Primary Examiner* — Felix O Figueroa
(74) *Attorney, Agent, or Firm* — WPAT, P.C.; Anthony King

(57) ABSTRACT

A cable-to-board connector includes a plug connector and a receptacle connector. The plug connector includes a plug housing, a plurality of plug terminals disposed in the plug housing, and a plug shielding shell surrounding the plug housing. At least two buckling blocks protrude oppositely from two outer surfaces of two opposite sides of the plug shielding shell. The receptacle connector includes a receptacle housing, a plurality of receptacle terminals disposed in the receptacle housing, and a receptacle shielding shell defining a receptacle accommodating space therein. The receptacle housing is inserted in a front of the receptacle accommodating space. Each side of the receptacle shielding shell defines at least one second buckling hole. A rear inner periphery of the receptacle shielding shell is attached to a front outer periphery of the plug shielding shell with the buckling blocks being buckled in the second buckling holes.

7 Claims, 6 Drawing Sheets

CABLE-TO-BOARD CONNECTOR

BACKGROUND OF THE INVENTION

1. Field of the Invention

The present invention generally relates to a cable-to-board connector, and more particularly to a cable-to-board connector having a better electromagnetic shielding performance.

2. The Related Art

In general, a cable-to-board connector adapted for connecting between a cable and a circuit board includes a plug connector and a receptacle connector. The plug connector includes a plug housing, a plurality of plug terminals disposed in the plug housing, and a plug shielding shell surrounding the plug housing. The receptacle connector includes a receptacle housing, a plurality of receptacle terminals disposed in the receptacle housing, and a receptacle shielding shell surrounding the receptacle housing. When the plug connector is engaged with the receptacle connector, the plug terminals electrically contact with the receptacle terminals to realize an electrical connection between the cable and the circuit board. However, the plug shielding shell is apart from the receptacle shielding shell to weaken an electromagnetic shielding performance of the cable-to-board connector that affects the electrical connection between the cable and the circuit board.

SUMMARY OF THE INVENTION

An object of the present invention is to provide a cable-to-board connector includes a plug connector adapted for connecting with a cable, and a receptacle connector adapted for being soldered on a circuit board and engaged with the plug connector. The plug connector includes a plug housing, a plurality of plug terminals and a plug shielding shell. The plug housing has a base portion and a tongue portion protruded forward from a front of the base portion. The tongue portion defines an inserting groove having a front opened freely. The plug housing defines two rows of plug terminal grooves of which each has a rear thereof penetrating through the base portion and a front thereof penetrating through a top wall or a bottom wall of the tongue portion. Each of the plug terminals is received in the plug terminal groove with a rear end thereof being fastened in the rear of the plug terminal groove and connected with the cable, and a front end thereof being exposed out from the top wall or the bottom wall. The plug shielding shell of an integrative structure surrounds the base portion of the plug housing. At least two buckling blocks protrude oppositely from two outer surfaces of two opposite sides of the plug shielding shell. The receptacle connector includes a receptacle housing, a plurality of receptacle terminals and a receptacle shielding shell. The receptacle housing has a front wall, two lateral walls, an upper wall and a lower wall which are interconnected to form a receiving space thereamong for receiving the tongue portion therein. An inserting portion protrudes rearward from an inner face of the front wall to be inserted into the inserting groove. The receptacle housing defines two rows of receptacle terminal grooves of which each has one side thereof passing through an inner face of the upper wall or the lower wall, and the front wall, and the other side thereof passing through a side surface of the inserting portion facing the inner face of the upper wall or the lower wall, and the front wall. The receptacle terminals are received in the receptacle terminal grooves respectively. Each receptacle terminal has a soldering portion projecting out of the receptacle housing to be soldered on the circuit board. One end of the soldering portion defines two contact portions spaced from each other and respectively inserted into the two sides of the receptacle terminal groove to contact with the front end of the corresponding plug terminal. The receptacle shielding shell is looped from a metal plate with a receptacle accommodating space being formed therein. The receptacle housing is inserted in a front of the receptacle accommodating space of the receptacle shielding shell. Each side of the receptacle shielding shell defines at least one second buckling hole. A rear inner periphery of the receptacle shielding shell is attached to a front outer periphery of the plug shielding shell with the buckling blocks being buckled in the second buckling holes. At least two soldering arms bend outward from a periphery front of the receptacle shielding shell to be soldered on the circuit board.

As described above, the rear inner periphery of the receptacle shielding shell is attached to the front outer periphery of the plug shielding shell with the buckling blocks being buckled in the second buckling holes to make the plug shielding shell effectively connect with the receptacle shielding shell. Thus, a better electromagnetic shielding effectiveness is acquired to achieve a steady signal transmission between the cable and the circuit board.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
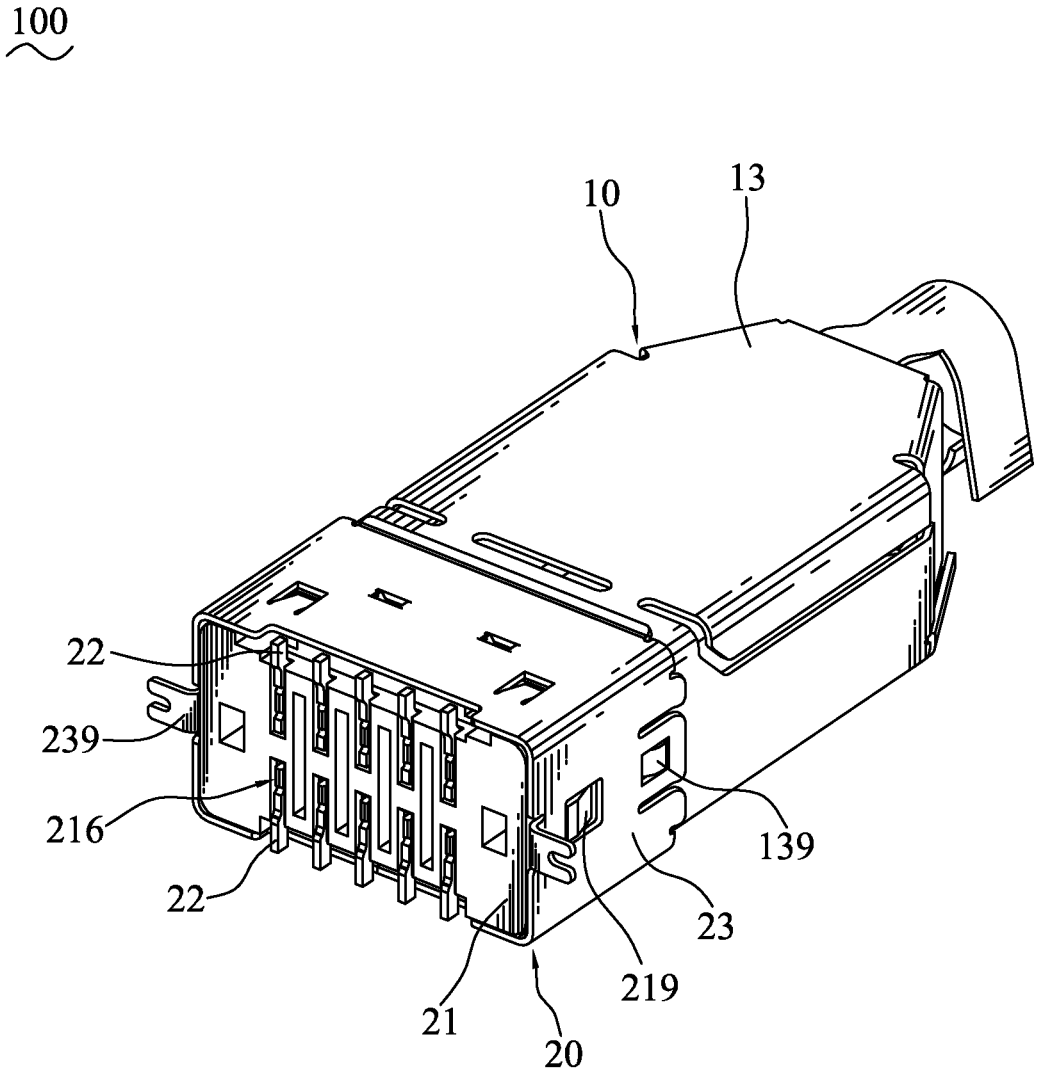
FIG. 1 is a perspective view of a cable-to-board connector in accordance with the present invention, wherein the cable-to-board connector includes a plug connector and a receptacle connector which are engaged with each other.
Figure 2:
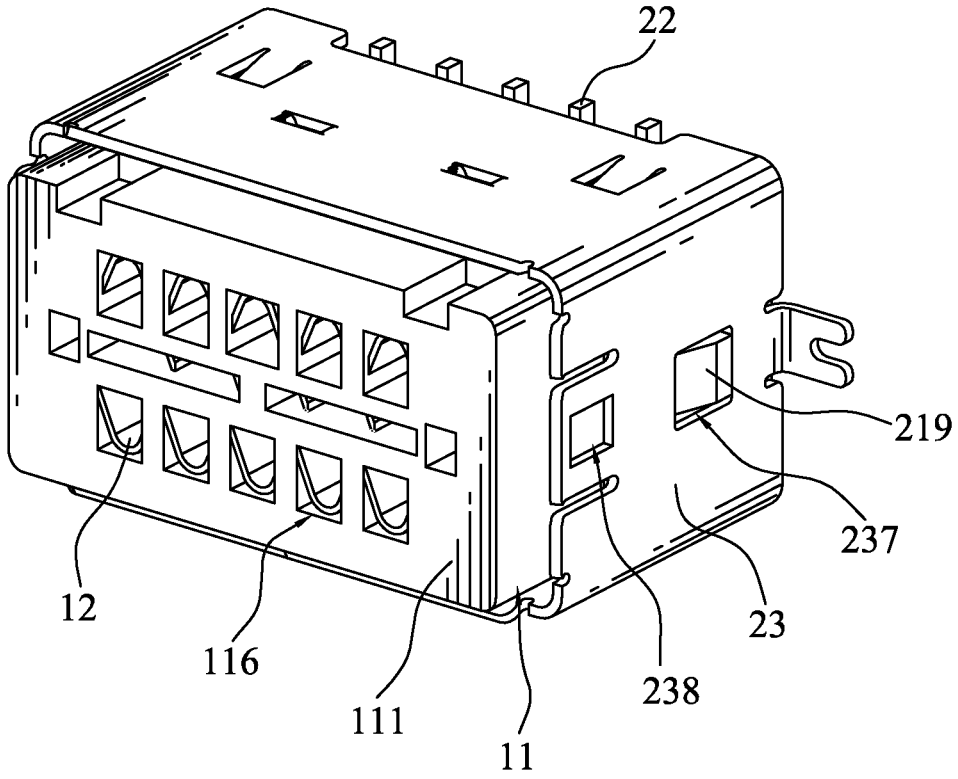
FIG. 2 is a perspective view of the cable-to-board connector of FIG. 1, wherein a plug shielding shell of the plug connector is disassembled from the cable-to-board connector.
Figure 3:
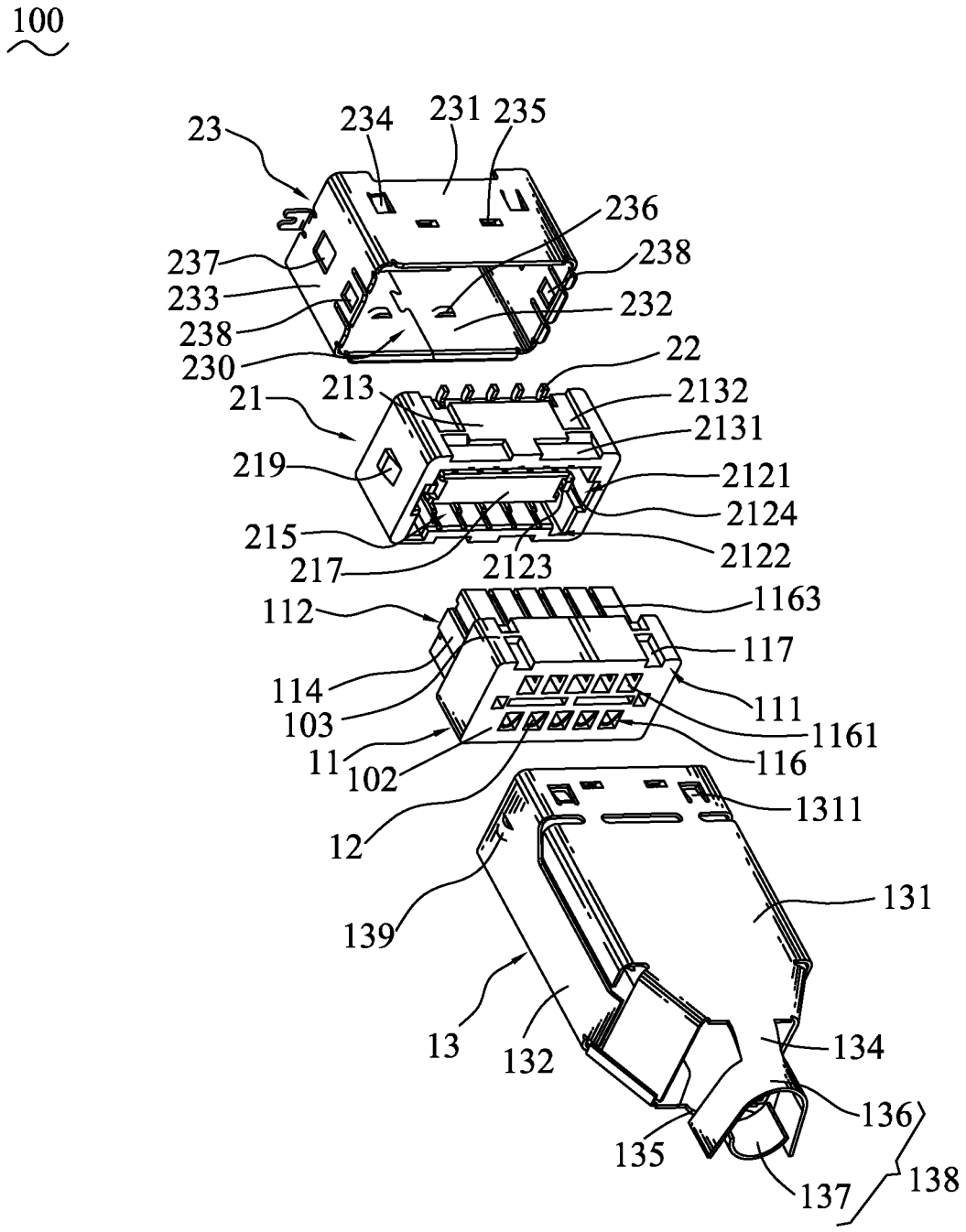
FIG. 3 is a partially exploded view of the cable-to-board connector of FIG. 1.

With reference to FIG. 1, FIG. 2 and FIG. 3, a cable-to-board connector 100 in accordance with the present invention is shown. The cable-to-board connector 100 adapted for connecting between a cable (not shown) and a circuit board (not shown) includes a plug connector 10 and a receptacle connector 20.

Referring to FIG. 1, FIG. 3, FIG. 4 and FIG. 5, the plug connector 10 includes a plug housing 11, a plurality of plug terminals 12 and a plug shielding shell 13. The plug housing 11 has a base portion 111 and a tongue portion 112 of a substantially rectangular hollow shape protruded forward from a middle of a front surface 101 of the base portion 111. Accordingly, an inserting groove 113 is formed in a middle of the tongue portion 112 and has a front opened freely. Two middles of two outer faces of two opposite side walls 1122 of the tongue portion 112 protrude oppositely and extending along a front-to-rear direction to form two protruding blocks 114. Two opposite sides of a top wall 1121 of the tongue portion 112 protrude upward to form two ribs 115. Two middles of two inner faces of the two opposite side walls 1122 of the tongue portion 112 are concaved oppositely to form two cavities 1124. Two tops of two facing inner walls of the two cavities 1124 protrude face to face to form two protrusions 1125. The plug housing 11 defines two rows of plug terminal grooves 116. Each row of the plug terminal grooves 116 is arranged at regular intervals along a transverse direction of the plug housing 11.

Each plug terminal groove 116 includes a rectangular receiving groove 1161 extending along the front-to-rear direction to penetrate through a rear surface 102 of the base portion 111, a fastening groove 1162 extending along the front-to-rear direction into the corresponding top wall 1121 or the bottom wall 1123 of the tongue portion 112 from an outer end of a front of the receiving groove 1161, with a middle thereof vertically penetrating through the top wall 1121 or the bottom wall 1123, and a U-shaped holding groove 1163 extending along the front-to-rear direction to penetrate through a front of the base portion 111, and connecting with the front of the receiving groove 1161 and a rear of the fastening groove 1162. A rear of a top surface 103 of the base portion 111 defines two first recesses 117 passing through the front surface 101. A front of a bottom surface 104 of the base portion 111 defines two third recesses 119 passing through the front surface 101.

Figure 4:
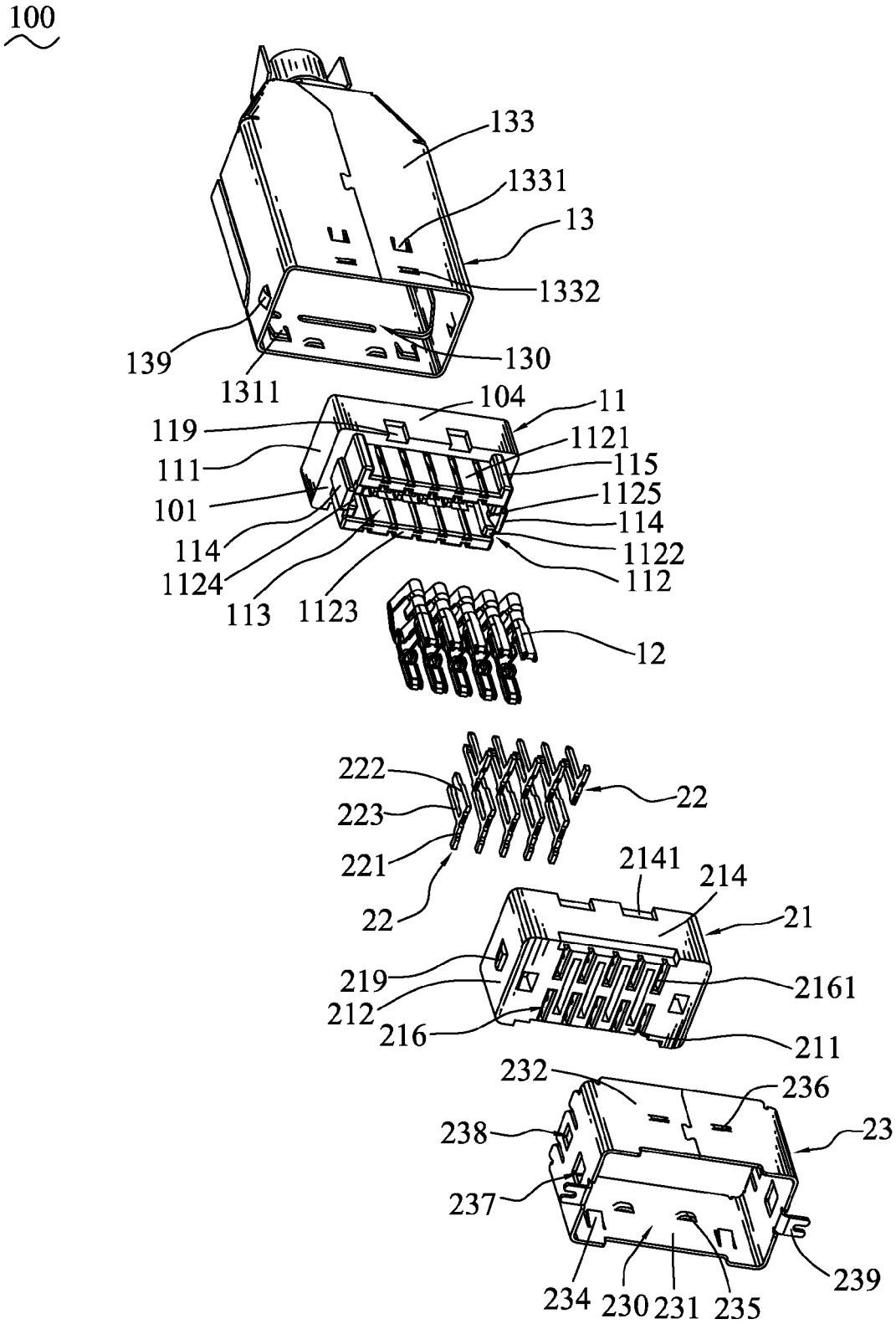
FIG. 4 is an exploded view of the cable-to-board connector of FIG. 1.
Figure 5:
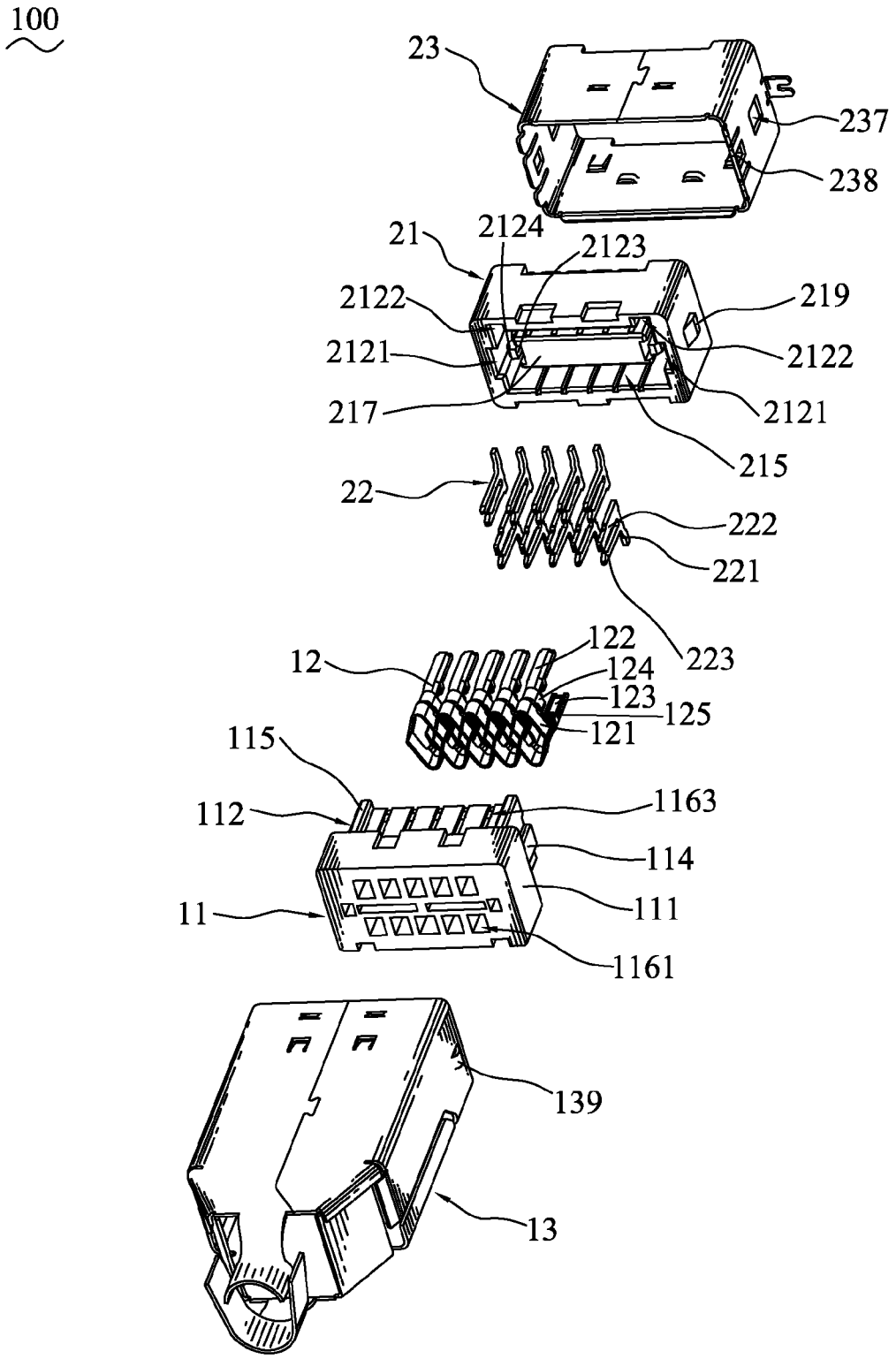
FIG. 5 is another exploded view of the cable-to-board connector of FIG. 1.
Figure 6:
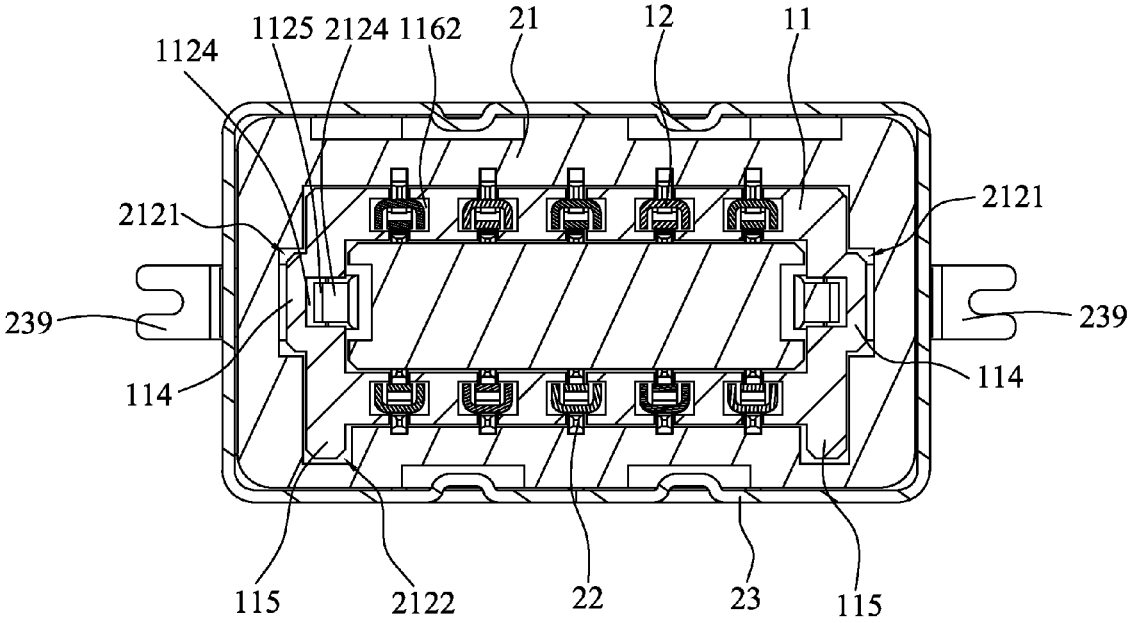
FIG. 6 is a sectional view of the cable-to-board connector of FIG. 1.

Referring to FIG. 4 and FIG. 5, each of the plug terminals 12 has two first fastening arms 121 connected with each other to show a V shape from a rear view. A front of a junction of the two fastening arms 121 extends forward to form a first contact arm 122. A middle of a front of the first contact arm 122 is folded up towards the first contact arm 122 to form a second contact arm 123. Two second fastening arms 124 are inclined oppositely from two sides of the first contact arm 122, and located in front of the two first fastening arms 121. Two middles of the two sides of the first contact arm 122 are bent towards each other to form two third fastening arms 125 located between the second contact arm 123 and the two second fastening arms 124.

With reference to FIG. 1, FIG. 3, FIG. 4 and FIG. 5, the plug shielding shell 13 is of an integrative structure. The plug shielding shell 13 has a top plug plate 131, two side plug plates 132 and a bottom plug plate 133 which are interconnected with each other to together surround a plug accommodating space 130 thereamong. Two middles of two rear ends of the top plug plate 131 and the bottom plug plate 133 are inclined towards each other to form a top connecting arm 134 and a bottom connecting arm 135 respectively. A free end of the top connecting arm 134 is connected with an arc-shaped first clamping piece 136 and a free end of the bottom connecting arm 135 is connected with an arc-shaped second clamping piece 137. The first clamping piece 136 is matched with the second clamping piece 137 to together define a clamping ring 138. Two fronts of two outer surfaces of the two side plug plates 132 protrude oppositely to form two buckling blocks 139. Two portions of a front end of the top plug plate 131 are punched inward to form two first buckling pieces 1311. A front end of the bottom plug plate 133 defines two second buckling pieces 1331 punched inward therefrom, and two convex portions 1332 convex inward therefrom and in alignment with the two second buckling pieces 1331 respectively.

Referring to FIG. 1, FIG. 3, FIG. 4, FIG. 5 and FIG. 6, when the plug connector 10 is assembled, the plug terminals 12 are received in the plug terminal grooves 116 with the first fastening arms 121 being received in the receiving grooves 1161, the second fastening arms 124 being received in the holding grooves 1163, and the third fastening arms 125 being blocked by the front of the base portion 111. The first contact arms 122 and the second contact arms 123 are fastened in the fastening grooves 1162 with middles of the first and second contact arms 122, 123 being exposed from the middles of the fastening grooves 1162. The cable is fastened in the first fastening arms 121, the second fastening arms 124, and the third fastening arms 125 through the clamping ring 138 to connect with the plug terminals 12 of the plug connector 10. The base portion 111 is inserted rearward into the plug accommodating space 130 of the plug shielding shell 13 with the first buckling pieces 1311 being buckled in the first recesses 117, the two convex portions 1332 is restrained in the two third recesses 119 and the second buckling pieces 1331 resisting against the rear surface 102.

With reference to FIGS. 1-5, the receptacle connector 20 includes a receptacle housing 21, a plurality of receptacle terminals 22 and a receptacle shielding shell 23. The receptacle housing 21 has a front wall 211, two lateral walls 212, an upper wall 213 and a lower wall 214 which are interconnected to form a receiving space 215 thereamong. A middle of an inner face of the front wall 211 protrudes rearward to form an inserting portion 217 projecting into the receiving space 215. The receptacle insulating housing 21 defines two rows of receptacle terminal grooves 216. Each row of the plug terminal grooves 216 is arranged at regular intervals along a transverse direction of the receptacle housing 21. Each receptacle terminal groove 216 includes a clipping slot 2161 penetrating through a front of the front wall 211 and a front of the corresponding upper wall 213 or the lower wall 214, an L-shaped first fixing slot 2162 passing through an inner face of the upper wall 213 or the lower wall 214, and the front wall 211, and an L-shaped second fixing slot 2163 passing through a side surface of the inserting portion 217 facing the inner face of the upper wall 213 or the lower wall 214, and the front wall 211. The second fixing slot 2163 is symmetrical to the first fixing slot 2162.

The upper wall 213 defines two first limiting grooves 2131 at a rear thereof and passing through a rear edge thereof, and two buckling grooves 2132 at a front thereof and passing through a front edge thereof. The lower wall 214 defines two second limiting grooves 2141 at a rear thereof and passing through a rear edge thereof. Two outer faces of the two lateral walls 212 protrude oppositely to form two buckling portions 219. Two inner faces of the two lateral walls 212 are concaved oppositely to form two locating grooves 2121. Two opposite sides of an inner face of the lower wall 214 are concaved downward to form two fillisters 2122. Two opposite sides of the inner face of the front wall 211 protrude rearward to form two pillars 2123 located at two opposite sides of the inserting portion 217. Two tops of two outer faces of the two pillars 2123 protrude oppositely to form two hooking portions 2124.

Referring to FIG. 4, each of the receptacle terminals 22 has a soldering portion 221 disposed vertically. Two portions of one end of the soldering portion 221 protrude rearward to define a first contact portion 222 and a second contact portion 223 spaced from each other.

Referring to FIG. 2, FIG. 3, FIG. 4 and FIG. 5, the receptacle shielding shell 23 looped from a metal plate has a top receptacle plate 231, a bottom receptacle plate 232 and two side receptacle plates 233 which are interconnected with each other to form a receptacle accommodating space 230 thereamong. Two portions of a front of the top receptacle plate 231 are punched inward to form two second buckling pieces 234. Two portions of a middle of the top receptacle plate 231 are convex inward to form two first blocking portions 235 located in a rear of an interval between the two second buckling pieces 234. Two portions of a middle of the bottom receptacle plate 232 are convex inward to form two second blocking portions 236 facing to the two first blocking portions 235. Each of the two side receptacle plates 233 defines a first buckling hole 237 at a front thereof, and a second buckling hole 238 at a rear thereof and in alignment with the first buckling hole 237. Two middles of two fronts of the two side receptacle plates 233 bend outward to form two soldering arms 239.

Referring to FIG. 1, FIG. 2, FIG. 3, FIG. 4 and FIG. 5, when the receptacle connector 20 is assembled, the receptacle terminals 22 are received in the receptacle terminal grooves 216 with the first contact portions 222 and the second contact portions 223 being fixed in the first fixing slots 2162 and the second fixing slots 2163 and projecting into the receiving space 215. The soldering portions 221 of the receptacle terminals 22 are clipped in the clipping slots 2161 with free ends thereof projecting out of the receptacle housing 21 to be soldered on the circuit board. The receptacle housing 21 is inserted in a front of the receptacle accommodating space 230 of the receptacle shielding shell 23 with the second buckling pieces 234 being buckled in the buckling grooves 2132, the first blocking portions 235 being blocked in the first limiting grooves 2131, the second blocking portions 236 being blocked in the second limiting grooves 2141, and the buckling portions 219 being buckled in the first buckling holes 237 to integrate the receptacle shielding shell 23 together with the receptacle housing 21 tightly. The soldering arms 239 are soldered on the circuit board.

Referring to FIGS. 1-6, in use, when the plug connector 10 is engaged with the receptacle connector 20, the tongue portion 112 is inserted into the receiving space 215 with the inserting portion 217 being inserted in the inserting groove 113 and resisting against the front surface 101 of the base portion 111. Because the ribs 115 are fastened in the fillisters 2122, a wrong operation can be avoided by virtue of the top wall 1121 of the tongue portion 112 being inserted into a top of the receiving space 215 and the bottom wall 1123 of the tongue portion 112 being inserted into a bottom of the receiving space 215. The protruding blocks 114 are located in the locating grooves 2121 and the hooking portions 2124 hooking the protrusions 1125 to integrate the plug housing 11 and the receptacle housing 21 firmly. The first contact arms 122 contact with the first contact portions 222, and the second contact arms 123 contact with the second contact portions 223 to realize an electrical connection between the plug connector 10 and the receptacle connector 20 so as to electrically connect the cable with the circuit board. A rear inner periphery of the receptacle shielding shell 23 is attached to a front outer periphery of the plug shielding shell 13 with the two buckling blocks 139 being buckled in the second buckling holes 238 to make the plug shielding shell 13 effectively connect with the receptacle shielding shell 23. Thus, a better retentiveness and a steady insertion and withdrawal force are provided for the plug connector 10 in the receptacle connector 20, and a better electromagnetic shielding effectiveness is acquired to achieve a steady signal transmission between the cable and the circuit board.

As described above, the rear inner periphery of the receptacle shielding shell 23 is attached to the front outer periphery of the plug shielding shell 13 with the buckling blocks 139 being buckled in the second buckling holes 238 to make the plug shielding shell 13 effectively connect with the receptacle shielding shell 23. Furthermore, the plug housing 11 is integrated with the receptacle housing 21 firmly by means of the protruding blocks 114 being located in the locating grooves 2121 and the hooking portions 2124 hooking the protrusions 1125. Thus, the better retentiveness and the steady insertion and withdrawal force are provided for the plug connector 10 in the receptacle connector 20, and the better electromagnetic shielding effectiveness is acquired to achieve the steady signal transmission between the cable and the circuit board. In addition, the ribs 115 are fastened in the fillisters 2122 so as to avoid the wrong operation by virtue of the top wall 1121 of the tongue portion 112 being inserted into the top of the receiving space 215 and the bottom wall 1123 of the tongue portion 112 being inserted into the bottom of the receiving space 215.

What is claimed is:

1. A cable-to-board connector, comprising:

a plug connector adapted for connecting with a cable, the plug connector including a plug housing having a base portion and a tongue portion protruded forward from a front of the base portion, the tongue portion defining an inserting groove having a front opened freely, the plug housing defining two rows of plug terminal grooves of which each has a rear thereof penetrating through the base portion and a front thereof penetrating through a top wall or a bottom wall of the tongue portion, a plurality of plug terminals each received in the plug terminal groove with a rear end thereof being fastened in the rear of the plug terminal groove and connected with the cable, and a front end thereof being exposed out from the top wall or the bottom wall, and a plug shielding shell of an integrative structure surrounding the base portion of the plug housing, at least two buckling blocks protruding oppositely from two outer surfaces of two opposite sides of the plug shielding shell; and a receptacle connector adapted for being soldered on a circuit board and engaged with the plug connector, the receptacle connector including a receptacle housing having a front wall, two lateral walls, an upper wall and a lower wall which are interconnected to form a receiving space thereamong for receiving the tongue portion therein, an inserting portion protruding rearward from an inner face of the front wall to be inserted into the inserting groove, the receptacle housing defining two rows of receptacle terminal grooves of which each has one side thereof passing through an inner face of the upper wall or the lower wall, and the front wall, and the other side thereof passing through a side surface of the inserting portion facing the inner face of the upper wall or the lower wall, and the front wall, a plurality of receptacle terminals received in the receptacle terminal grooves respectively, each receptacle terminal having a soldering portion projecting out of the receptacle housing to be soldered on the circuit board, one end of the soldering portion defining two contact portions spaced from each other and respectively inserted into the two sides of the receptacle terminal groove to contact with the front end of the corresponding plug terminal, and a receptacle shielding shell looped from a metal plate with a receptacle accommodating space being formed therein, the receptacle housing being inserted in a front of the receptacle accommodating space of the receptacle shielding shell, each side of the receptacle shielding shell defining at least one second buckling hole, a rear inner periphery of the receptacle shielding shell being attached to a front outer periphery of the plug shielding shell with the buckling blocks being buckled in the second buckling holes, at least two soldering arms bending outward from a periphery front of the receptacle shielding shell to be soldered on the circuit board.

2. The cable-to-board connector as claimed in claim 1, wherein two inner faces of two opposite side walls of the tongue portion of the plug housing are concaved oppositely to form two cavities, two tops of two facing inner walls of the two cavities protrude face to face to form two protrusions, two opposite sides of the inner face of the front wall of the receptacle housing protrude rearward to form two pillars located at two opposite sides of the inserting portion, two tops of two outer faces of the two pillars protrude oppositely to form two hooking portions hooking the protrusions.

3. The cable-to-board connector as claimed in claim 1, wherein two opposite sides of the top wall of the tongue portion of the plug housing protrude upward to form two ribs, two opposite sides of an inner face of the lower wall of the receptacle housing are concaved downward to form two fillisters for fastening the ribs.

4. The cable-to-board connector as claimed in claim 1, wherein two outer faces of two opposite side walls of the tongue portion protrude oppositely and extending along a front-to-rear direction to form two protruding blocks, two inner faces of the two lateral walls are concaved oppositely to form two locating grooves for locating the two protruding blocks.

5. The cable-to-board connector as claimed in claim 1, wherein the upper wall of the receptacle housing defines two first limiting grooves at a rear thereof and passing through a rear edge thereof, and two buckling grooves at a front thereof and passing through a front edge thereof, the lower wall defines two second limiting grooves at a rear thereof and passing through a rear edge thereof, two outer faces of the two lateral walls protrude oppositely to form two buckling portions, a front of a top of the receptacle shielding shell defines two second buckling pieces buckled in the buckling grooves and two first blocking portions located in a rear of an interval between the two second buckling pieces to be blocked in the first limiting grooves, a bottom of the receptacle shielding shell defines two second blocking portions facing to the two first blocking portions to be blocked in the second limiting grooves, each side of the receptacle shielding shell defines a first buckling hole in front of the second buckling hole for buckling the corresponding buckling portion.

6. The cable-to-board connector as claimed in claim 1, wherein a top surface of the base portion defines two first recesses passing through the front of the base portion, a bottom surface of the base portion defines two third recesses passing through the front of the base portion, a front end of a top of the plug shielding shell defines two first buckling pieces buckled in the first recesses, a front end of a bottom of the plug shielding shell defines two second buckling pieces resisting against a rear surface of the base portion and two convex portions in alignment with the two second buckling pieces to be restrained in the two third recesses.

7. The cable-to-board connector as claimed in claim 1, wherein two fronts of the two sides of the receptacle shielding shell bend outward to form the two soldering arms.

* * * * *